US011266224B2

(12) United States Patent
Landano et al.

(10) Patent No.: US 11,266,224 B2
(45) Date of Patent: Mar. 8, 2022

(54) ERGONOMIC ROTATABLE APPARATUS AND METHOD FOR USE THEREOF TO CARRY AND STORE EQUIPMENT AND ACCESSORIES

(71) Applicants: Christopher Landano, Glendale, NY (US); James J Bordonaro, Bayshore, NY (US); James E Richardson, Eliot, MA (US)

(72) Inventors: Christopher Landano, Glendale, NY (US); James J Bordonaro, Bayshore, NY (US); James E Richardson, Eliot, MA (US)

(73) Assignee: Christopher Landano, Glendale, NY (US)

( * ) Notice: Subject to any disclaimer, the term of this patent is extended or adjusted under 35 U.S.C. 154(b) by 0 days.

(21) Appl. No.: 15/279,317

(22) Filed: Sep. 28, 2016

(65) Prior Publication Data

US 2018/0084893 A1 Mar. 29, 2018

Related U.S. Application Data

(63) Continuation-in-part of application No. 13/077,937, filed on Mar. 31, 2011, now abandoned.

(60) Provisional application No. 61/319,584, filed on Mar. 31, 2010.

(51) Int. Cl.

| | |
|---|---|
| ***A45F 5/02*** | (2006.01) |
| ***A45F 3/14*** | (2006.01) |
| ***A45F 3/00*** | (2006.01) |

(52) U.S. Cl.

CPC ..... *A45F 3/14* (2013.01); *A45F 3/005* (2013.01); *A45F 5/021* (2013.01); *A45F 2003/144* (2013.01); *A45F 2003/146* (2013.01); *A45F 2200/0533* (2013.01)

(58) Field of Classification Search

CPC .... A45F 5/021; A45F 2003/144; A45F 3/005; A45F 2200/0533

USPC ..... 224/676, 195, 663, 662, 632, 197, 192, 224/638

See application file for complete search history.

(56) References Cited

U.S. PATENT DOCUMENTS

| | | | | | |
|---|---|---|---|---|---|
| 775,149 | A * | 11/1904 | Righton | A45F 5/02 | 224/195 |
| 1,601,624 | A * | 9/1926 | Houghton | A45F 5/00 | 224/195 |
| 1,642,046 | A * | 9/1927 | Sauer | A41F 9/002 | 112/417 |
| 2,378,075 | A * | 6/1945 | Zigmonde | F21V 23/00 | 2/300 |
| 3,004,519 | A * | 10/1961 | Weissman | A47D 15/006 | 119/857 |
| 3,868,786 | A * | 3/1975 | Lippe | A01K 27/001 | 446/28 |

(Continued)

*Primary Examiner* — Justin M Larson
(74) *Attorney, Agent, or Firm* — Joseph Farco

(57) ABSTRACT

An apparatus for use about a selected portion of a user's torso comprising at least one accessory mountable traveler member and at least one traveler band. The accessory mountable traveler member is slidably saddled upon the least one traveler band, which encircles and encloses the selected portion of a user's torso to allow the circumvolution of the accessory mountable traveler member about the entire outer perimeter of the apparatus and around the user's torso.

20 Claims, 19 Drawing Sheets

(56) References Cited

U.S. PATENT DOCUMENTS 4,676,419 A * 6/1987 Victor ..... A45F 5/00 224/269
5,464,136 A * 11/1995 Eddy ..... A45F 5/02 2/308
5,665,057 A * 9/1997 Murphy ..... A61F 5/028 2/311
5,683,022 A * 11/1997 Evans ..... A41F 9/002 224/583
5,722,576 A * 3/1998 Rogers ..... A45F 5/02 224/195
5,881,933 A * 3/1999 Rogers ..... A41F 9/02 224/195
5,950,569 A * 9/1999 Perrulli ..... A01K 27/003 119/770
6,098,859 A * 8/2000 Bortner ..... A44B 11/12 224/195
6,216,931 B1 * 4/2001 Trawinski ..... A45F 3/14 224/255
6,431,424 B1 * 8/2002 Smith ..... A01K 97/10 224/153
6,837,188 B1 * 1/2005 Martin ..... A01K 27/005 119/792
7,762,440 B2 * 7/2010 Cook ..... F41C 33/046 2/338
7,770,770 B2 * 8/2010 Murdoch ..... A45C 11/38 224/672
7,950,554 B2 * 5/2011 Hoffner ..... A45F 5/02 224/222
7,992,506 B1 * 8/2011 Patton ..... B63B 35/7979 114/39.18
8,011,545 B2 * 9/2011 Murdoch ..... A45F 5/02 224/672
8,256,652 B2 * 9/2012 Murdoch ..... A45C 11/38 224/672
8,453,897 B2 * 6/2013 Burton ..... A45F 3/04 224/199
8,474,673 B2 * 7/2013 Murdoch ..... A45F 5/02 224/672
8,510,868 B2 * 8/2013 Mongan ..... F41C 33/046 2/300
8,985,411 B2 * 3/2015 Mongan ..... A45F 5/021 224/195
9,629,398 B2 * 4/2017 Goryl ..... A41D 13/0012
10,165,848 B2 * 1/2019 Danforth ..... A45F 3/14
10,231,500 B2 * 3/2019 Roberson ..... A01K 27/00
10,639,516 B2 * 5/2020 Thomas ..... A63B 21/4009
2003/0110550 A1 * 6/2003 Guibord ..... A41F 9/002 2/312
2004/0226972 A1 * 11/2004 Cook ..... A45F 5/021 224/195
2011/0240705 A1 * 10/2011 Landano ..... A45F 3/047 224/676
2014/0342882 A1 * 11/2014 Huang ..... A63B 21/222 482/110
2018/0084893 A1 * 3/2018 Landano ..... A45F 3/10

* cited by examiner

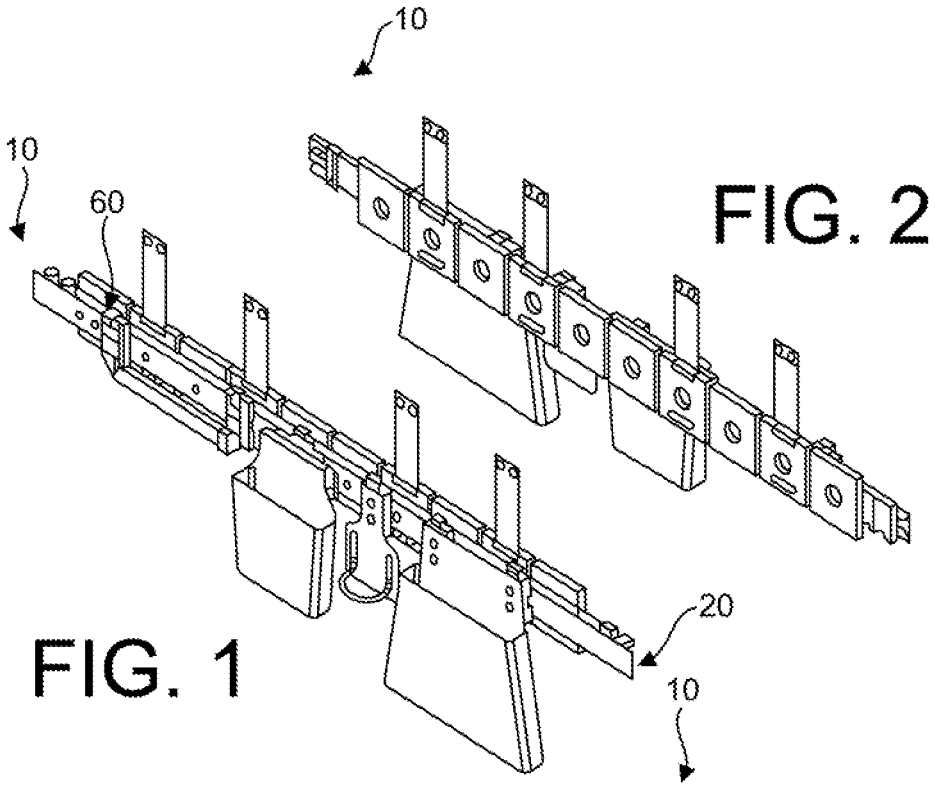
FIG. 2
FIG. 1
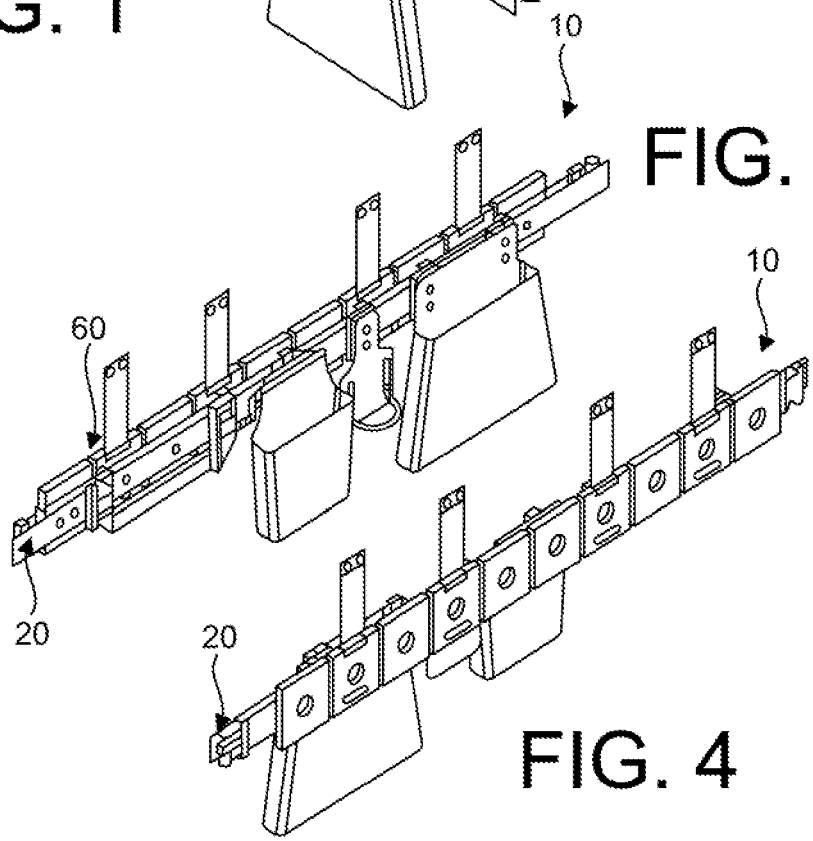
FIG. 3
FIG. 4

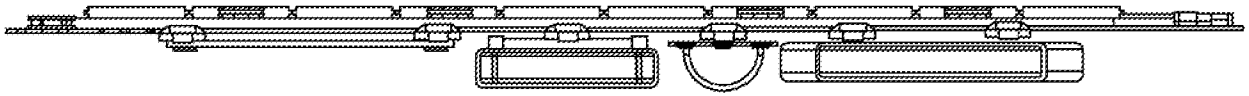
FIG. 16
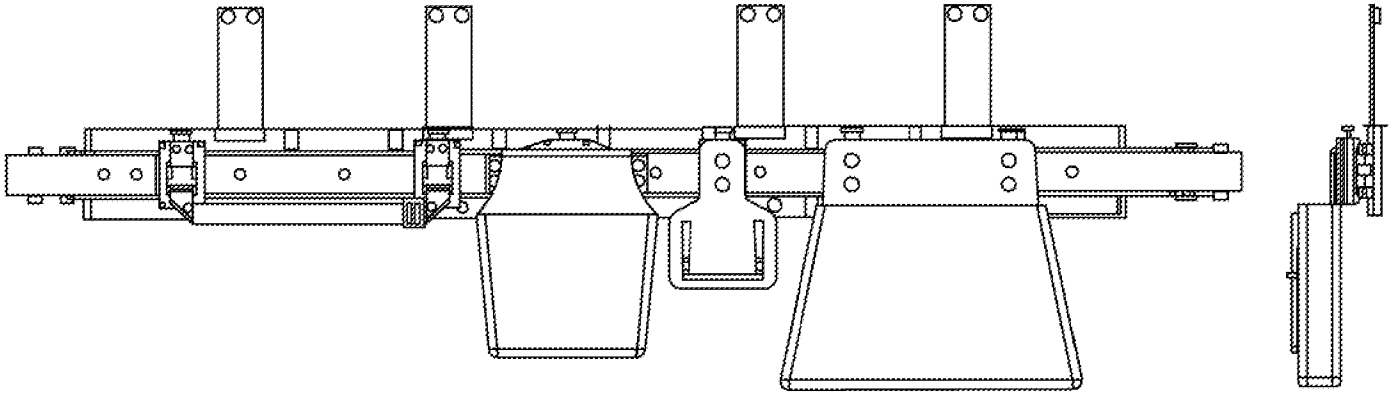
FIG. 15
FIG. 17

ERGONOMIC ROTATABLE APPARATUS AND METHOD FOR USE THEREOF TO CARRY AND STORE EQUIPMENT AND ACCESSORIES

RELATED APPLICATION

The present continuation-in-part application claims the benefit of the filing date of Non-Provisional application Ser. No. 13/077,937 filed on Mar. 31, 2011 which claimed the benefit of the filing date of Provisional Application No. 61/319,584 filed Mar. 31, 2010.

BACKGROUND OF THE INVENTION

Field of Invention

This invention relates to an apparatus and method for use primarily by photographers and other trade professionals such as police officers, construction workers and so on, as well as students, campers and others in connection with carrying and quickly accessing equipment and accessories. More particularly, the present invention relates to a vest-like apparatus and method of use thereof for storage and transport of all types of different equipment and accessories, both in the front and in the back of the vest-like apparatus, while simultaneously providing for easy and speedy access to said equipment, even to equipment located in the back of the vest-like apparatus, at a moment's notice, without removal or donning off thereof.

Prior Art

Trade professionals, sports enthusiasts, anyone who wears tools or equipment on their belt/harness, "Do it yourselfers", "Sports/Outdoor enthusiasts", Amusement park/stadium food and gift vendors and photographers work with an arsenal of equipment. Such arsenal of photographic equipment can include multiple cameras, multiple lenses, lens cleaners, filters, flashes, diffusers, batteries and so on.

In the case of photographers, for example, they carry their arsenal of photographic equipment in photography bags, carry-ons, and backpacks. However, as the photographers' arsenal of photographic equipment grows, so does the size and number of the photography bags, carry-ons and backpacks used by the photographers.

In an effort to keep their arsenal of photography equipment close at hand, photographers usually carry their photography bags and carry-ons by their straps, on their shoulder. Such carrying is bulky, heavy, shifts the load of the arsenal of photographic equipment onto one shoulder of the photographer, and very often results in injury to the photographers' neck, back and shoulders. In addition, such carrying and the structure of the bags and carry-ons prevents easy and quick access to important photographic equipment. More specifically none of the bags, carry-ons or even belts allow for the ability to quickly move equipment and supplies from the back of the wearer to the front without having to take of the devices or without some significant manipulation. Finally, such carrying and structure of the bags and carry ons, results in the loss of creative photographs due to the absence of a key piece of equipment necessary to capture the image for the creative photograph, for the simple reason that the bags are either so small or so bulky that the equipment was never packed, or even worse, was left behind.

Many devices have been developed in the past to help photographers carry their photographic equipment. They include bags, backpacks, and even vests. However none of these devices have been able to totally and completely solve the problems set forth herein above. Accordingly there is still a need for an apparatus and method that allows its user to carry a whole host of equipment, without physical stress, discomfort and injury to the user, while at the same time making such equipment accessible on short order with minimum effort, and preferably by simply revolving such equipment around the user.

SUMMARY OF THE INVENTION

Accordingly, it is an object of the present invention to provide an apparatus and method for the carrying of equipment and accessories that prevents the overloading of pockets found on the front portion of devices, coats, and jackets.

It is a further object of the present invention to provide an apparatus and method for the carrying of equipment and accessories that prevents physical stress and injury to the users of said apparatus.

It is still another object of the present invention to provide an apparatus and method that provides for significantly quicker and easier access to equipment and accessories by its users.

It is yet another object of the present invention to provide an apparatus and method that is basically donned on by the user of the apparatus and accessories, like an item of clothing such as a jacket or vest or a belt, but which allows for quick and easy access of the apparatus and accessories without having to take the inventive apparatus off or having to fuss or excessively manipulate the inventive device to access such equipment.

It is still another object of the present invention to provide an apparatus and method that is basically donned on by the user, like an item of clothing such as a jacket or vest, but which allows for quick and easy access of the equipment and accessories stored in the inventive apparatus by rotating the apparatus around the user's body from the front to the back and from the back to the front, without the removal of said apparatus.

It is a further object of the present invention to provide an apparatus and method that allows for the full storage of equipment and accessories and prevents them from being left behind or getting misplaced.

It is another object of the present invention to provide an apparatus and method that contributes to the taking of better and more creative pictures by better storing and easily accessing the proper equipment and accessories without damage thereto.

In accordance with the present invention there is provided a belt-like apparatus for use about a selected portion of a user's torso which has at least one accessory mountable traveler member and at least one traveler band. The accessory mountable traveler member is securely but slidably saddled upon the traveler band, which encircles and encloses the user's torso so as to allow the unimpeded revolution of the accessory mountable traveler member about the entire outer perimeter of the belt-like apparatus, from the front to the back of and around the user's torso.

These and other objects, advantages, features, and characteristics of the invention will be apparent from the following description of a preferred embodiment, considered along with the accompanying drawings.

BRIEF DESCRIPTION OF THE DRAWINGS

It is believed that the present invention will be better understood from the following detailed description taken in conjunction with the accompanying drawings, in which the numerals represent identical elements and wherein:

FIG. 1 is a three-dimensional, isometric, right to left view of the apparatus of the present invention;

FIG. 2 is a three-dimensional, isometric view of the back of the apparatus shown in FIG. 1;

FIG. 3 is another three-dimensional, isometric, left to right view of the apparatus shown in FIG. 1;

FIG. 4 is a three-dimensional, isometric view of the back of the apparatus of FIG. 3;

FIG. 15 is a plan three dimensional front view of the apparatus of the present invention.

FIG. 16 is a plan three dimensional top view of the inventive apparatus of FIG. 15.

FIG. 17 is a plan three dimensional side view of the inventive apparatus of FIG. 15.

LIST OF ELEMENTS AND THEIR RESPECTIVE IDENTIFYING NUMERALS

Figure 5:
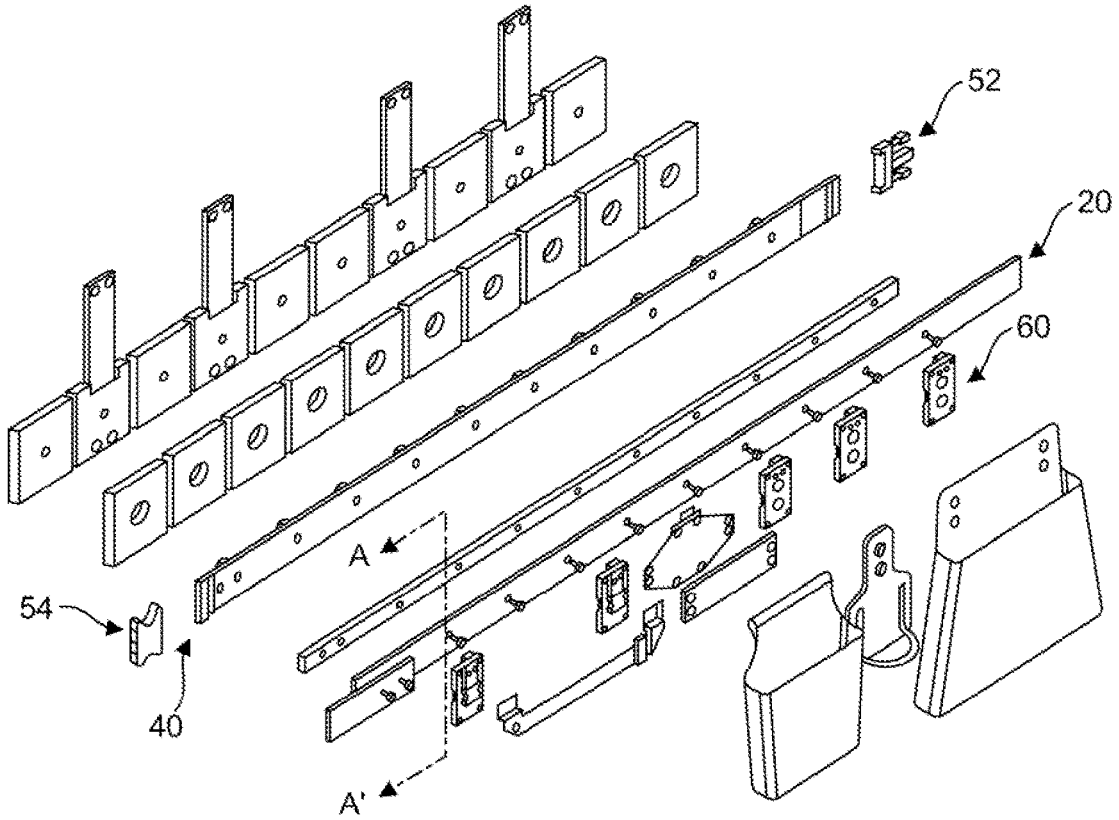
FIG. 5 is a three-dimensional, exploded, isometric view of the inventive apparatus of FIG. 3.
Figure 6:
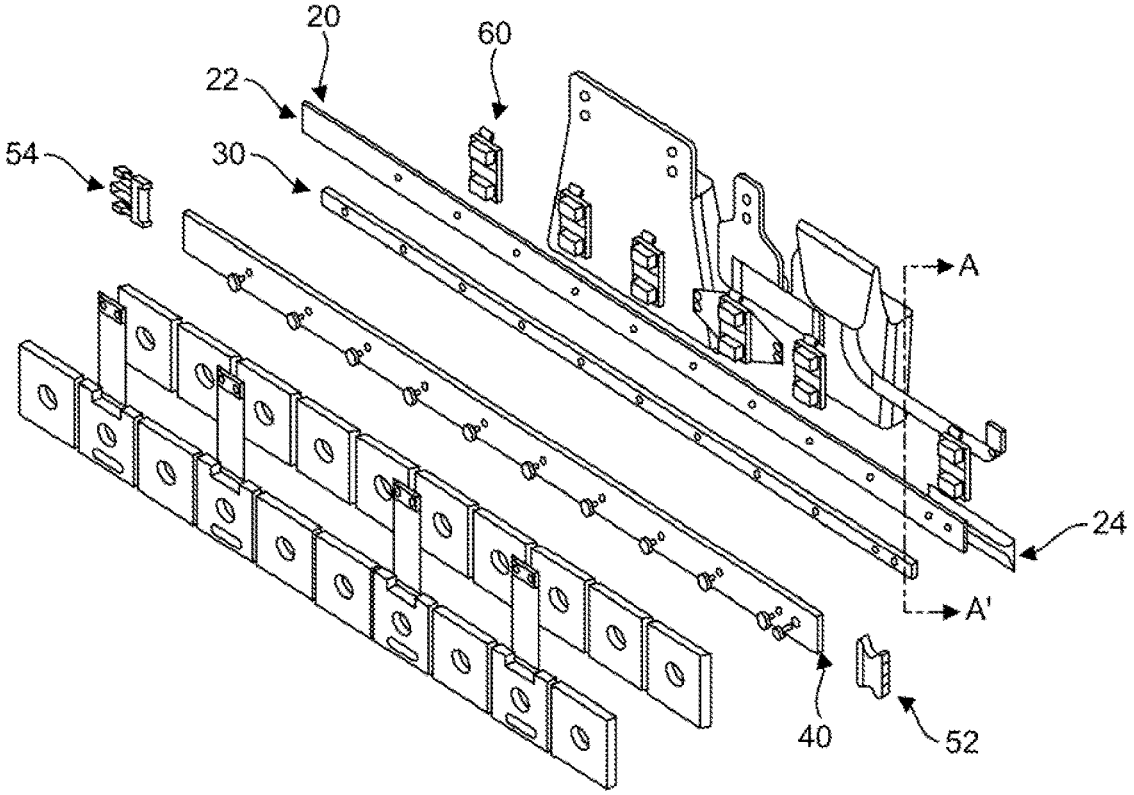
FIG. 6 is a three-dimensional, exploded, isometric view of the inventive apparatus of FIG. 2.
Figure 7:
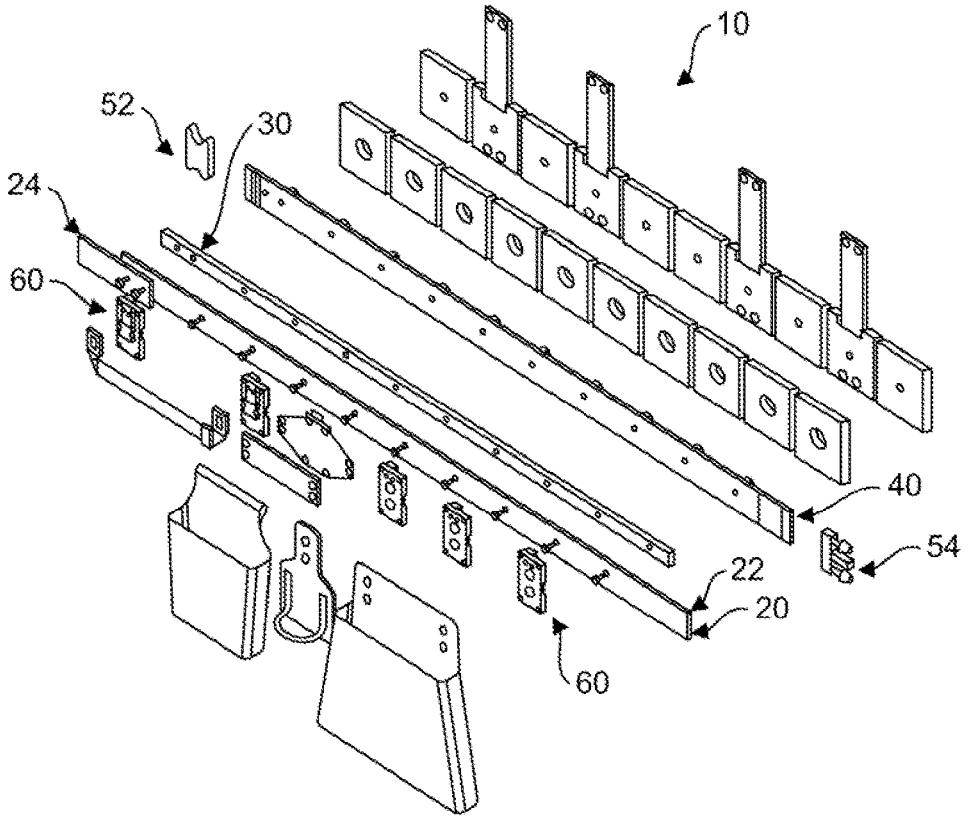
FIG. 7 is a three-dimensional, exploded, isometric view of the inventive apparatus of FIG. 1.
Figure 8:
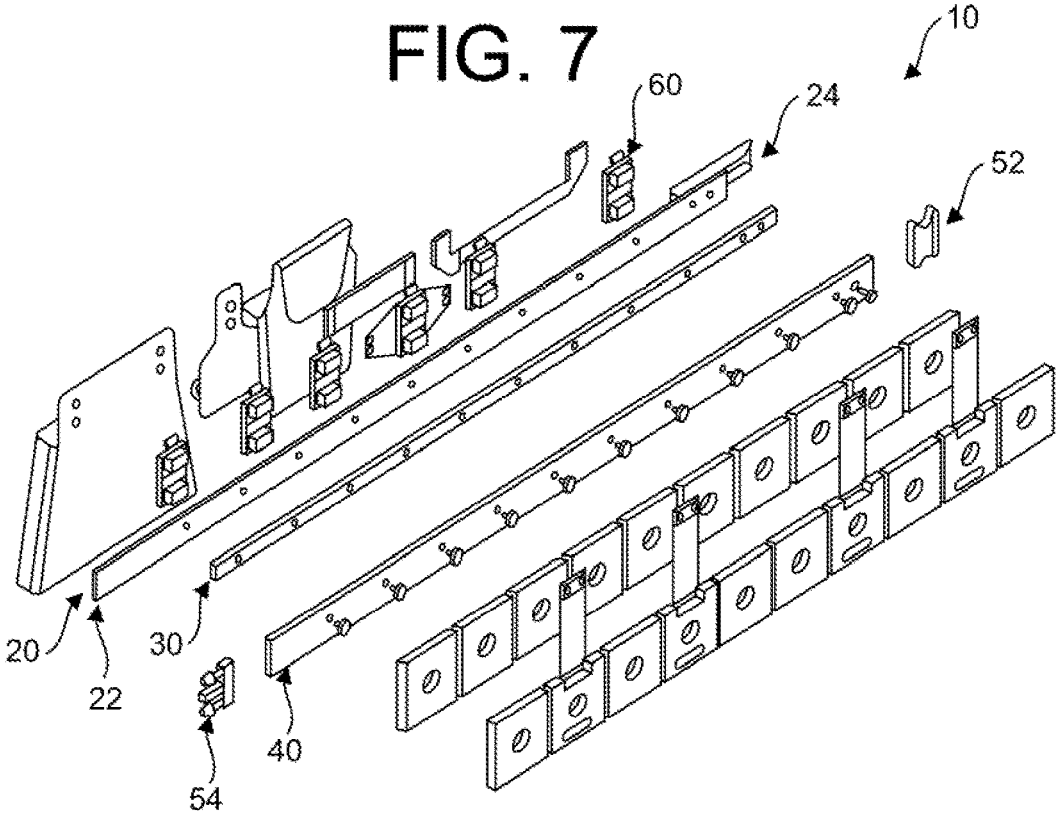
FIG. 8 is a three-dimensional, exploded, isometric view of the inventive apparatus of FIG. 4.
Figure 11:
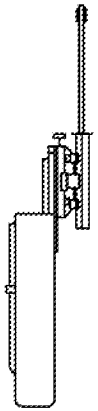
FIG. 11 is a plan side view of the inventive apparatus of FIG. 9.
Figure 9:
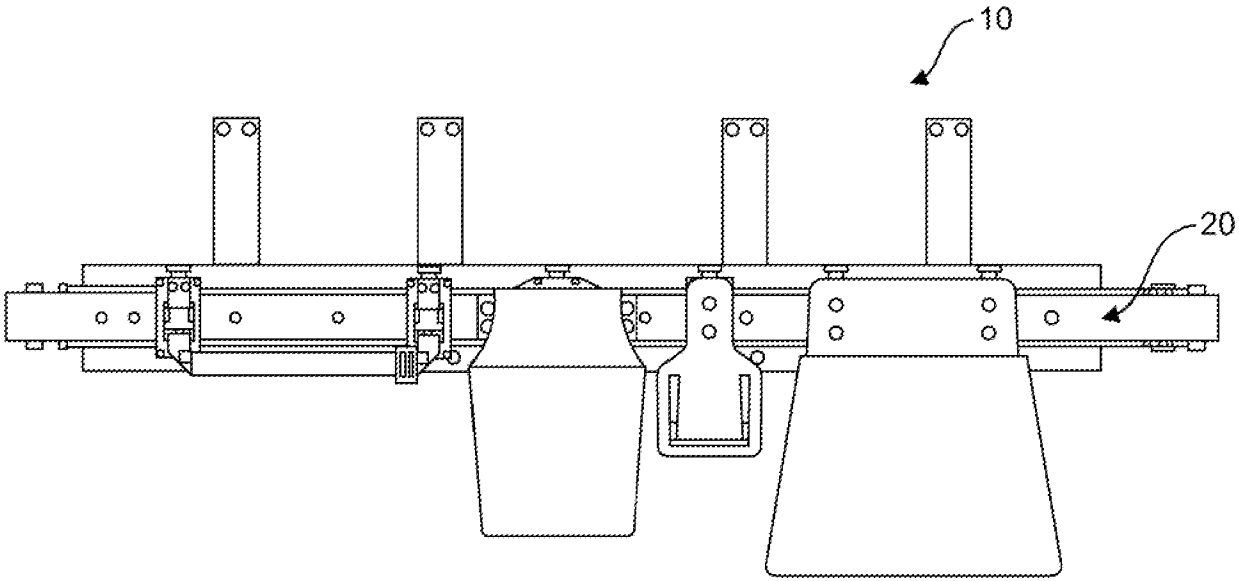
FIG. 9 is a plan front view of the apparatus of the present invention.
Figure 10:
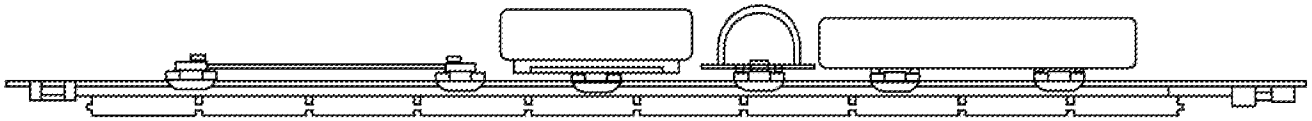
FIG. 10 is a plan bottom view of the inventive apparatus of FIG. 9.
Figures 13, 14:
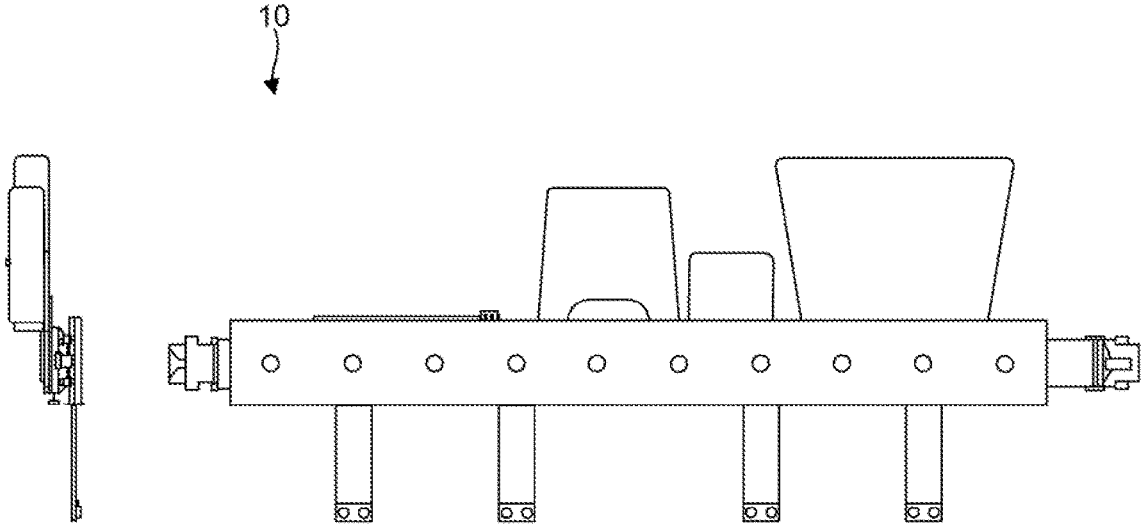
FIG. 13 is a plan back side view of the inventive apparatus of FIG. 9.
FIG. 14 is plan side view of the inventive apparatus of FIG. 13.
Figure 12:
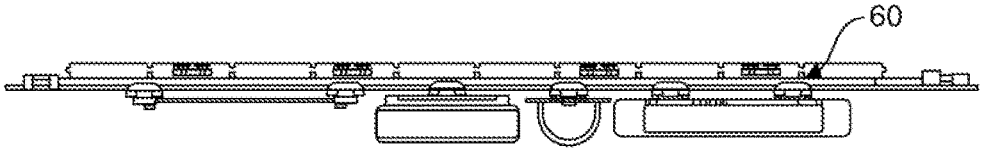
FIG. 12 is a plan top view of the inventive apparatus of FIG. 9.
Figure 19:
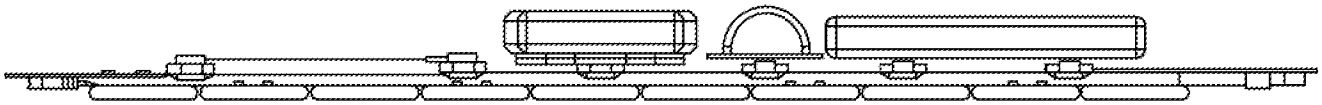
FIG. 19 is a plan, three dimensional bottom view of the inventive apparatus of FIG. 15.
Figure 18:
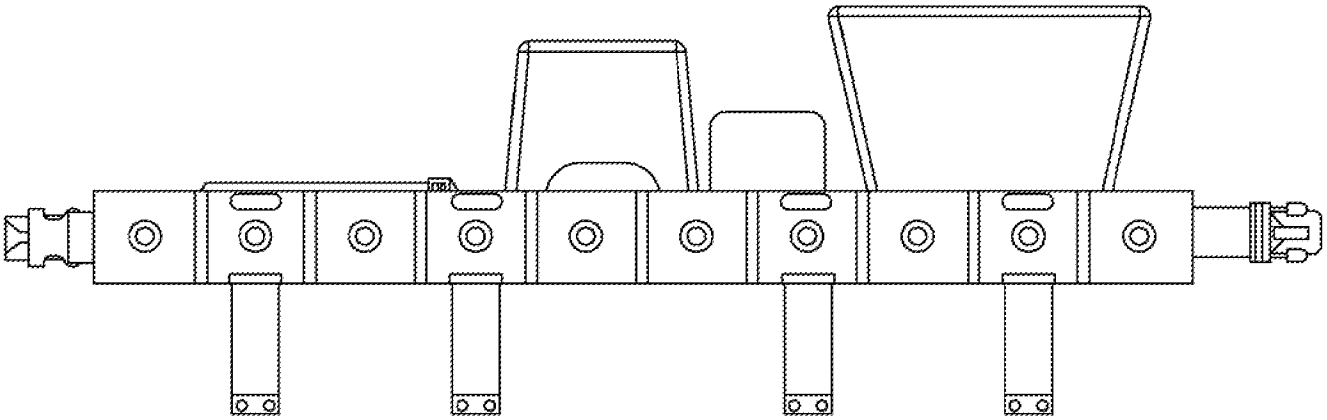
FIG. 18 is a plan, three dimensional back view of the inventive apparatus of FIG. 15.
Figure 20:
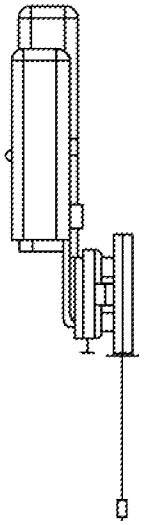
FIG. 20 is plan side view of the inventive apparatus of FIG. 18.
Figure 21:
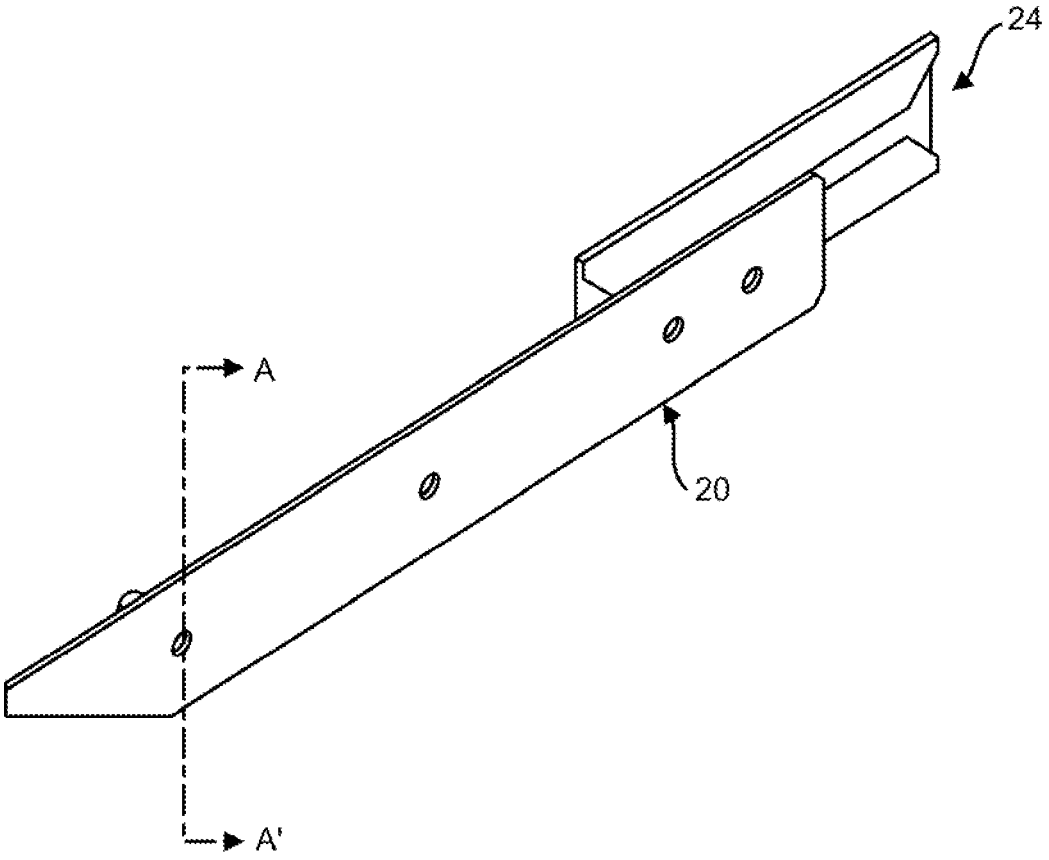
FIG. 21 is a three dimensional, exploded, enlarged, partial, isometric view of the sleeve end of the tracker band of the inventive apparatus taken through line A-A' in FIGS. 5-8.
Figure 22:
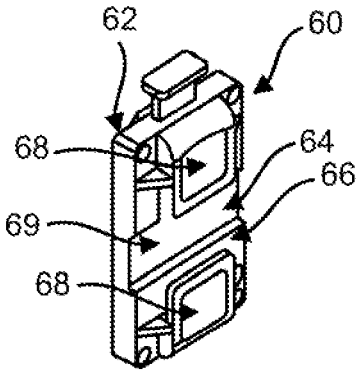
FIG. 22 is a three-dimensional, enlarged isometric view of one embodiment of the traveler member shown in more detail, in FIGS. 5-8.
Figure 23:
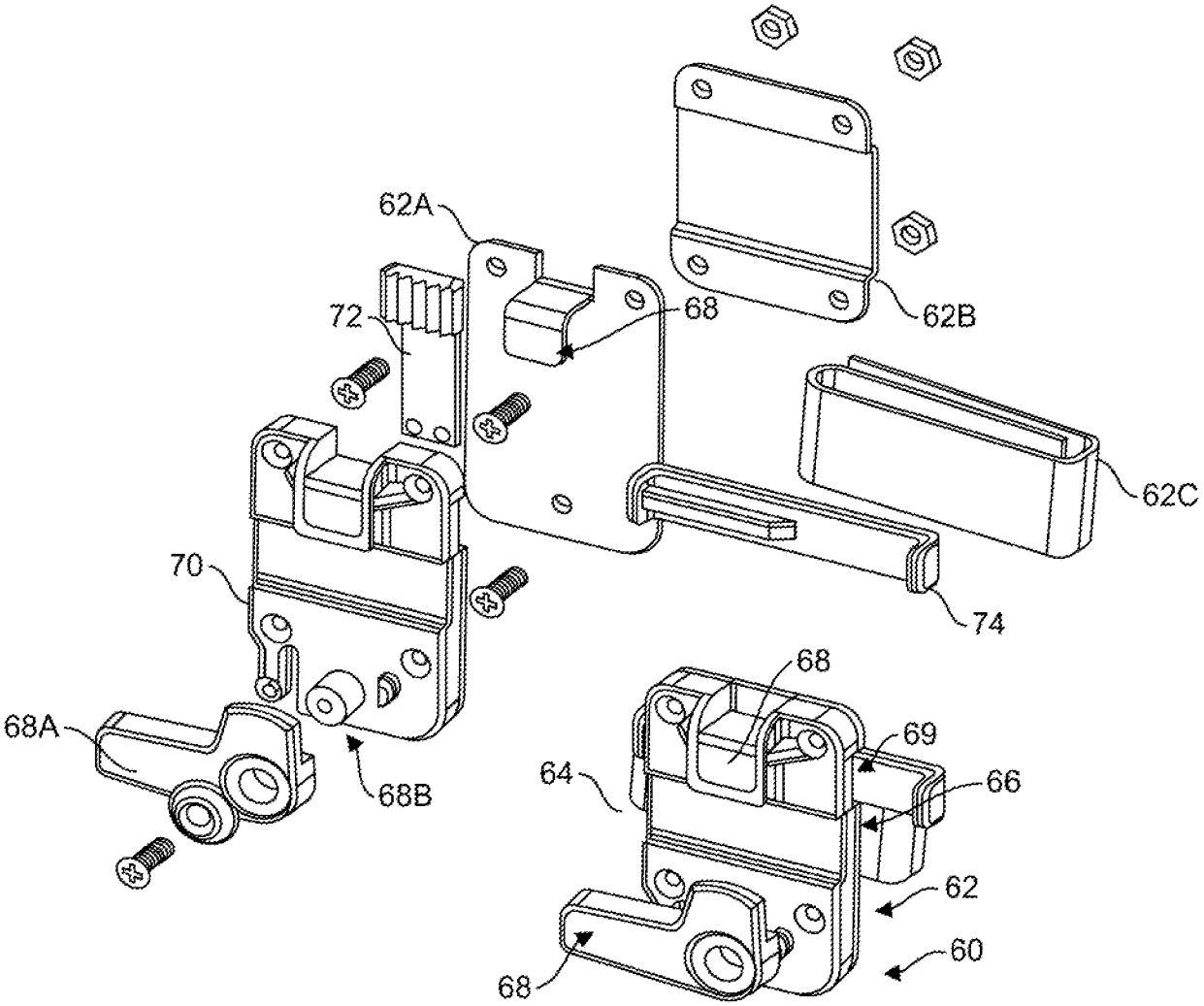
FIG. 23 is a three-dimensional, exploded, enlarged isometric view of another embodiment of the traveler member shown in more detail, in FIGS. 5-8.
Figure 24:
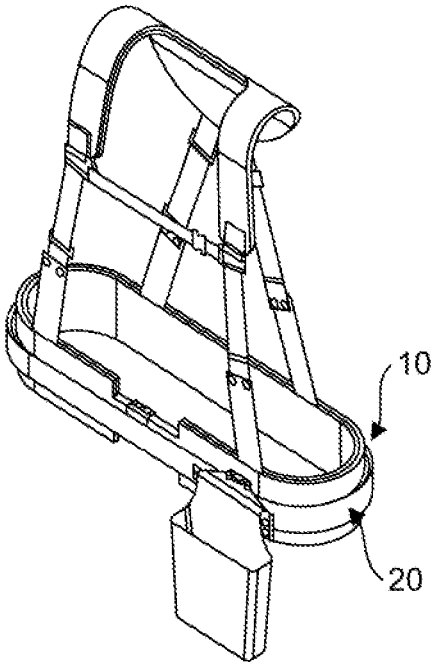
FIGS. 24-27 are three-dimensional, isometric views of the inventive apparatus as appended on a harness-like or suspender vest, from different angles and showing the 360° path of the traveler band around the central logitudinal axis of the harness-like or suspender vest.
Figure 25:
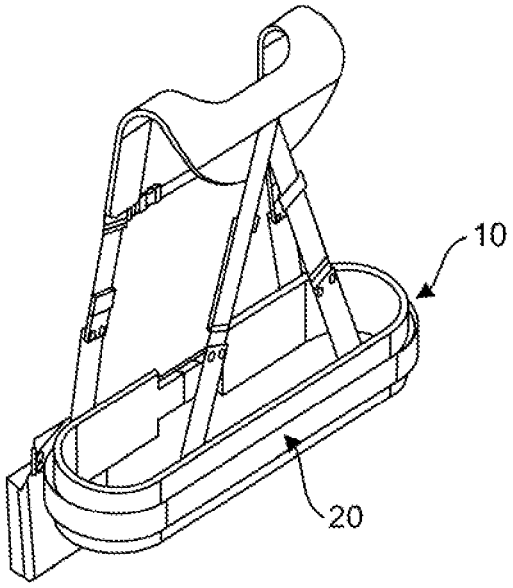
Figure 26:
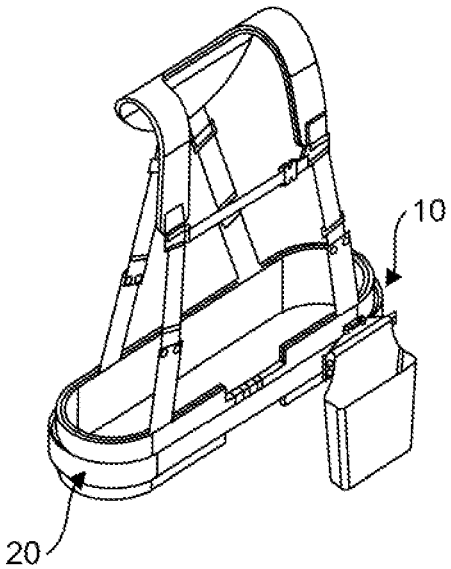
Figure 27:
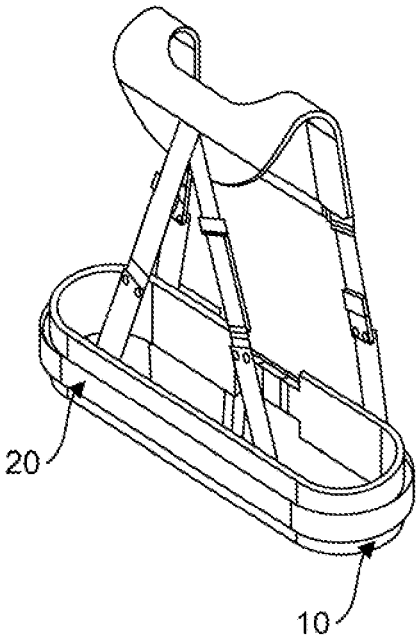
Figure 28:
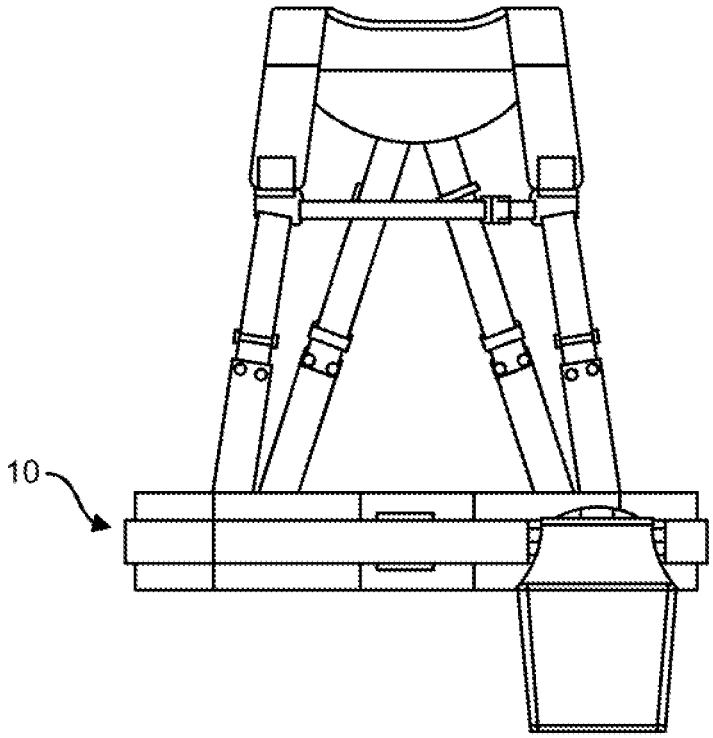
FIG. 28 is a plan three-dimensional front view of the apparatus of the present invention appended on a harness-like or suspender vest.
Figure 29:
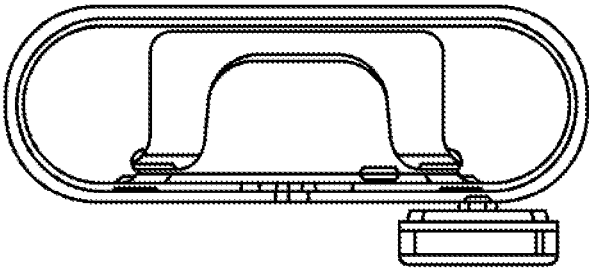
FIG. 29 is a plan three dimensional top view of the inventive apparatus appended on the harness-like or suspender vest of FIG. 28.
Figure 30:
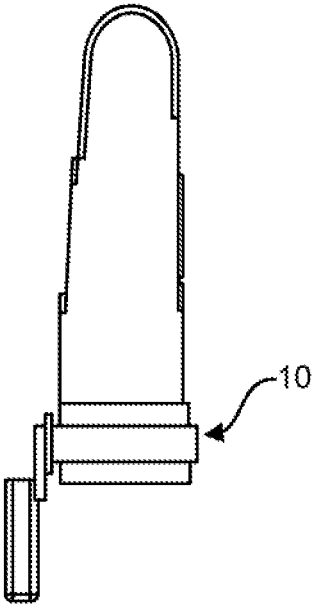
FIG. 30 is a plan three dimensional side view of the inventive apparatus appended on the harness-like or suspender vest of FIG. 28.
Figure 31:
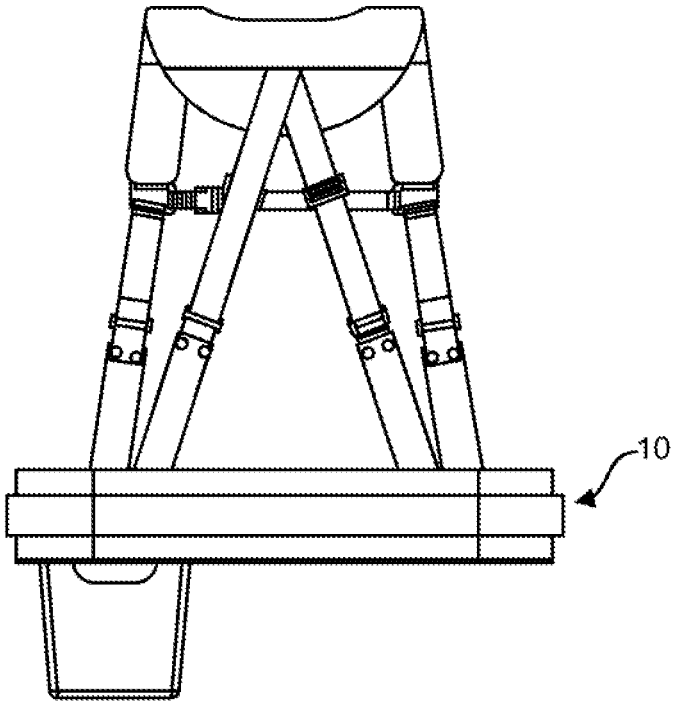
FIG. 31 is a plan, three dimensional back view of the inventive apparatus as appended on the harness-like or suspender vest of FIG. 28.
Figure 32:
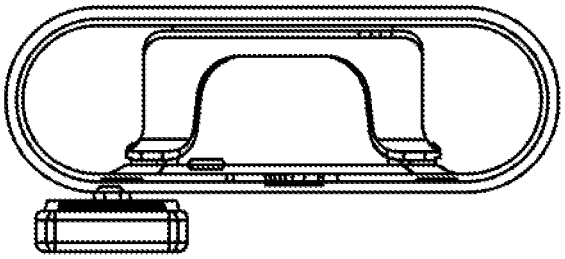
FIG. 32 is a plan, three dimensional bottom view of the inventive apparatus as appended on the harness-like or suspender vest of FIG. 28.
Figure 33:
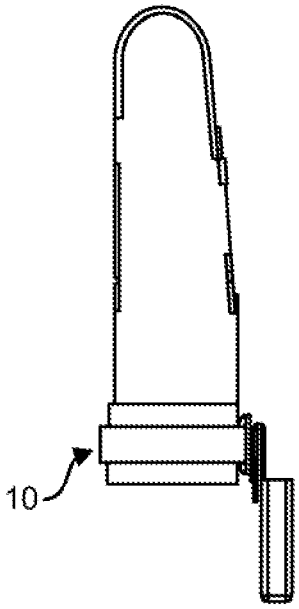
FIG. 33 is plan side view of the inventive apparatus as appended on the harness-like or suspender vest of FIG. 31.

| NO | ELEMENT |
|---|---|
| 10 | The inventive belt-like apparatus |
| 20 | traveler band |
| 22 | tongue end of traveler band |
| 24 | sleeve end of traveler band |
| 30 | spacer strip |
| 40 | strap |
| 50 | releasable buckle |
| 52 | female side of the releasable buckle |
| 54 | male side of the releasable buckle |
| 60 | traveler member |
| 62 | accessory mounting face |
| 62A | Backplate |
| 62B | Velcro loop retaining plate |
| 62C | Double sided Velcro |
| 62D | webbing |
| 62E | buckle |
| 64 | saddle face |
| 66 | saddle seat |
| 68 | saddle flanks or arms |
| 68A | Retaining lever |
| 68B | Pivot nub |
| 69 | c-shaped groove |
| 70 | Traveler body |
| 72 | Nylon clamp |
| 74 | clamp activation cross slide |
| 100 | Shoulder straps |
| 110 | rotating utility belt |
| 112 | Webbing |
| 112A | Outer surface of the webbing 112 |
| 112B | Inner surface of the webbing 112 |
| 114 | track system |
| 114A | track |
| 114B | base for track system 114 |
| 116 | Channel members |
| 117 | Saddle |
| 117A | Outer side of the saddle |
| 117B | Inner side of the saddle |
| 118 | Bracket |
| 118A | Outer Surface of the Bracket |
| 118B | Inner Surface of the Bracket |
| 118C | Slide Channel on the Bracket |
| 119 | Male connection of a clip on pocket 70 |
| 120 | quick release clips |
| 122 | Quick release buttons |

DETAILED DESCRIPTION OF THE PREFERRED EMBODIMENT

Referring more specifically to FIGS. 1-4, and FIGS. 24-27, the inventive belt-like apparatus, which can optionally be placed around a user's torso, is generally depicted at 10. It is designed to provide for the mounting, carrying and storage of equipment and accessories and to freely circumvolve such equipment and accessories around the wearer's torso, thereby providing access to such equipment and accessories with speed and ease at a moment's notice; without removing the belt-like apparatus. It can be worn by itself as is shown in FIGS. 1-4, or it can be mounted on a vest-like harness capable of being placed on a user's torso as is shown in FIGS. 24-27 and FIG. 34.

The inventive belt-like apparatus 10 is provided with at least one accessory mountable traveler member 60 and at least one traveler band 20. The accessory mountable traveler member 60 is slidably saddled upon the traveler band 20. The traveler band 20 in turn form one single pathway for the traveler member 60, which encircles and encloses a selected portion of the user's torso to allow the unimpeded revolution or circumvolution of the traveler member 60 about the entire outer perimeter of the belt-like apparatus 10, around the user's torso.

The traveler band 20 has a first end and a second end. The first end is slightly tapered to form a thin tongue end 22. The second end, which is opposite to the first end or the tongue end 22, is provided with a clasp-like or sleeve end 24. In use, the sleeve end 24 fixedly but removably receives and engages the tongue end 22, when the tongue end is inserted therein, thereby closing the traveler band 20 and forming the single continuous unimpeded pathway for the traveler member 60, around the user's torso withing the belt-like apparatus 10.

The accessory mountable traveler member 60 in turn, consists of an accessory mounting face 62 and a saddle face 64. When the traveler member is slidably saddled onto the traveler band, and the belt-like apparatus 10 is closed, i.e., when the tongue end 22 is inserted into the sleeve end 24 of the traveler band 20, the accessory mounting face 62 is directed outwardly, away from the user's torso. It is designed, and is provided with means, for mounting accessories or gear onto the travel member 60. Such mounting means can be anything that is currently available, or will be made available in the future, for mounting or attaching or supporting gear, accessories and so on. In one embodiment it is provided with a VELCRO® loop retaining plate 62B and double sided VELCRO®. In another embodiment it is provided with a webbing strip 62D, permanently and securely fixed on the accessory face 62, together with a buckle 62E attached to the webbing 62D, to which a pouch can be attached.

By comparison, when the traveler member is slidably saddled onto the traveler band, and the belt-like apparatus is closed, the saddle face 64 is directed inwardly, towards the user's torso or the center of the belt-like apparatus 10. It comprises a saddle seat 66 and two flanks 68 horizontally extending therefrom, such that said flanks 68 and said saddle seat 66 form a c-shaped groove 69 capable of embracing and slidably mating with the traveler band 20, thereby allowing the accessory mountable travel member 60 to freely circumnavigate around the entire circumference of the traveler band 20 and by extension the belt-like apparatus 10 when the need arises. Optionally, the accessory mountable travel member 60 can also be provided with a means for preventing it from slidably moving along the traveler band 20, as for example when the belt-like apparatus 10 is not being used, or it is being used primarily for carrying.

The belt-like apparatus is further provided with at least one spacer strip 30, upon which the traveler band 20 is mounted. The space strip 30 can be one continuous strip or it could be an intermittently continuous strip around the entire outer circumference of the belt-like apparatus 10. It acts as a base for the traveler band 20 and as a mechanism to create a space between the traveler band 20 and the belt-like apparatus. The width of the space created is complimentary to the thickness of the saddle flanks 68, and ever so slightly wider, to permit the unimpeded circumvolution of the traveler member 60 around the outer perimeter of the belt-like apparatus 10.

The belt like apparatus can optionally be equipped with a strap 40 and a releasable buckle 50. The strap acts as a base support for the spacer strip 30. The releasable buckle in turn, has a female component 52 and a male component 54, each of the male and female components being fixedly attached to each of the first end and second end of the strap 40, respectively. Further, the traveler band tongue and opposite sleeve ends 22 and 24 longitudinally extend beyond each of the first and second ends of said spacer strip and beyond the free end edges of the male and female components 54 and 52 of the strap 40, respectively.

In one embodiment of the inventive ergonomic rotatable belt-like apparatus 10 for carrying, storing and accessing accessories and field gear, it comprises a layered belt travel band system having outer, inner and intermediate layers for slidably securing at least one field gear container. It has at least one outer layer securing travel band 20, which can optionally be an elongated, flexible semirigid rail-like band or strap having attachment means for attaching to and removing the apparatus from a user's body in a belt-like manner.

The at least one semirigid rail-like band or strap can be a thin, elongated strip of flexible semirigid material having an outer surface and an opposite inner surface. It optionally has a width of from about 3 mm to about 6 mm (preferably about 4 mm) and a thickness of from about 0.05 mm to about 0.40 mm (preferably about 0.15 min).

The at least one semirigid rail-like band or strap has a top edge and a corresponding opposite bottom edge, these edges being coextensive with the at least one semirigid rail strip. Further, it has a tongue end 22 and an opposite clasp or sleeve end 24 capable of receiving and grasping the tongue end of the at least one semirigid rail-like band or strap. Optionally, the clasp end can be a plate with curved edges forming an insertion slot for accepting insertion of the tongue end 22 and a width about the same as that of the at least one semirigid rail-like band or strap and a thickness of from about 1.01 to about 1.15 times the thickness of the at least one semirigid rail strip. Finally, the clasp is having user-operable quick release means for releasably securing said semirigid rail strip within said clasp to form a circumferential belt about a selected portion of a user's body for securing accessories and field gear.

The layered belt traveler band system further has a second intermediate layer comprising a padded elongated spacer layer of a suitable resilient material having, respectively, opposite outer and inner surfaces, a width and a thickness, said its outer surface being in contact with and substantially coextensive with and in center-alignment with the inner surface of the at least one semirigid rail-like band or strap outer layer forming traveler band 20. Optionally, the thickness of the second resilient padded spacer layer is from about 3 times to about 10 times the thickness of the at least one semirigid rail-like band or strap; and the width is from about 0.5 times to about 0.9 times the width of said at least one semirigid rail-like band or strap.

Optionally, the layered belt traveler band system is equipped with a third intermediate layer comprising a flexible elongated belt layer made of a suitable strong and flexible belting material. It has opposite outer and inner surfaces, a width and a thickness, and the outer surface of the third belt layer being in contact with and substantially coextensive with and in center-alignment with the inner surface of the second resilient padded spacer layer. The thickness of the third belt layer is suitable to impart sufficient tensile strength integrity to the system to securely grasp a selected body part of a user. Further, the third intermediate belt layer has a pair of opposite ends having quick release fastening means for fastening them together to form a belt; and optionally a width of 1 times to about 1.5 times the width of the at least one semirigid rail-like band or strip and a length that is shorter than the length of the semi-rigid rail-like band or strip so that when it is fastened the buckle is under but spaced apart from the closed tongue and sleeve ends.

Finally, the layered belt traveler band system can be optionally equipped with a fourth elongated inner padding layer made of a suitable resilient padding material. It too has opposite outer and inner surfaces, a width and a thickness, and the outer surface of the fourth inner padding layer being in contact with and substantially coextensive with and in center-alignment with the inner surface of the third intermediate layer belt layer. The inner surface of the fourth elongated inner padding layer is for contact with the body of a user upon deployment of said system claimed herein.

The thickness of the fourth inner padding layer is sufficient to pad the system in contact with the body of the user and to vector distribute about the user's body the downward force of the weight of field gear containers that are secured to said system. Its width can optionally be from about 1.5 times to about 3.0 times the width of the at least one semirigid rail-like band or strap. Optionally it could comprise a plurality of contiguous pad segments, said segments comprising a continuum that in turn comprises the fourth inner layer; each segment respectively having a pair of opposite vertically extending sides, said vertical sides having fastening means thereon for fastening to the respective adjacent contiguous respective pad segment. The fastening means for fastening fourth inner layer pad segments to the respective adjacent contiguous respective pad segment may optionally comprise hook and loop fastener means.

The outer, intermediate and inner layers are fastened together by a plurality of fastening means affixed spaced-apart upon the system. They are disposed substantially at or near the centerline of said system. They extend laterally through suitably aligned apertures in all layers to comprise a means for fastening together and fixing in place the layers of said system.

The layered belt traveler band system is equipped with at least one quick release slidable rigid securing traveler member having an outer side and an inner side. In one embodiment the inner side has a central groove for engaging and slidably mounting the respective upper and lower edges of the at least one semirigid rail-like band or strap forming the travel band 20. Optionally, the quick release traveler member 60 is provided with locking means, said locking means being user-movable between an open un-locked position and a closed, locked position, said locking means comprising a convenient user-openable and user-closable means such as a retaining lever 68A, for attaching and alternately detaching said traveler member 60 from the at least one semirigid rail-like band or strip, the groove on the inner surface of the at least one traveler member for slidably grasping said at least one semirigid rail-like band or strap; the groove securely but slidably fixing the traveler member 60 to the at least one semirigid rail-like band or strap. The outer surface of traveler member 60 has means for releasably securing a field gear pocket thereto.

Another embodiment of the ergonomic rotatable apparatus for carrying, storing and accessing accessories and field gear comprising layered belt rail system having outer, inner and intermediate layers for slidably securing at least one field gear container, has:

at least one outer layer securing rail, said at least one securing rail comprising an elongated flexible semirigid rail strip; said at least one semirigid rail strip having attachment means for attaching to and removing said system from a portion of the user's body in a belt-like manner; wherein said at least one semirigid rail strip being further comprised of a thin, elongated strip of flexible semirigid material having an outer surface and an opposite inner surface, having a width of about 4 mm and a thickness of about 0.15 mm; wherein further said at least one semirigid rail strip has a top edge and a corresponding opposite bottom edge, said edges being coextensive with said at least one semirigid rail strip; and wherein said at least one semirigid rail strip has a tongue end and an opposite clasp end, said clasp end having a clasp for grasping said tongue end of said at least one semirigid rail strip, said clasp comprising a plate having an insertion slot for accepting insertion of said tongue end of said at least one semirigid rail strip; wherein said clasp plate comprises a width about the same as that of said at least one semirigid rail strip and a thickness of about 1.15 times the thickness of said at least one semirigid rail strip and wherein said plate and extends longitudinally from said clasp end of said at least one semirigid rail strip;

said clasp further having user-operable quick release means for releasably securing said semirigid rail strip within said clasp to form a circumferential belt about a selected portion of a user's body 1 for securing field gear; and wherein said system having a second intermediate layer comprising a padded elongated spacer layer comprised of a suitable resilient material, said second resilient padded spacer layer having, respectively, opposite outer and inner surfaces, a width and a thickness, said outer surface of said second spacer layer being in contact with and substantially coextensive with and in center-alignment with said inner surface of said at least one semirigid rail strip outer layer, and wherein said thickness of said second resilient padded spacer layer being from about 3 times to about 10 times the thickness of said at least one semirigid rail strip; and wherein said width of said second resilient padded spacer layer being from about 0.5 times to about 0.9 times the width of said at least one semirigid rail strip; and wherein said system having a third intermediate layer comprising a flexible elongated belt layer comprised of a suitable strong and flexible belting material, said third belt layer having, respectively, opposite outer and inner surfaces, a width and a thickness, said outer surface of said third belt layer being in contact with and substantially coextensive with and in center-alignment with said inner surface of said second resilient padded spacer layer, and wherein said thickness of said third belt layer is suitable to impart sufficient tensile strength integrity to said system to securely grasp a selected body part of a user; and wherein said third intermediate belt layer comprises a respective pair of opposite ends, said ends having quick release fastening means for fastening said ends together to form a belt; and wherein said width of said third intermediate layer belt layer is from 1.0 times to about 1.5 times the width of said at least one semirigid rail strip; and wherein said system having a fourth elongated inner padding layer comprised of a suitable resilient padding material, said fourth inner padding layer having, respectively, opposite outer and inner surfaces, a width and a thickness, said outer surface of said fourth inner padding layer being in contact with and substantially coextensive with and in center-alignment with said inner surface of said third intermediate layer belt layer, and wherein said inner surface of said fourth elongated inner padding layer is for contact with the body of a user upon deployment of said system claimed herein; and wherein said thickness of said fourth inner padding layer being sufficient to pad the system in contact with the body of a user and to vector distribute about the user's body the downward force of the weight of field gear containers that are secured to said system, and wherein said width of said fourth inner padding layer being about 2 times the width of said at least one semirigid rail strip; and wherein said outer, intermediate and inner layers are fastened together by a plurality of fastening means affixed spaced-apart upon said system, said fastening means disposed substantially at or near the centerline of said system, said fastening means extending laterally through suitably aligned apertures in all layers to comprise a means for fastening together and fixing in place said layers of said system; and wherein said system has at least one quick release slidable rigid securing cleat having an outer side and an inner side, said inner side having a central groove for engaging said respective upper and lower edges of said at least one semirigid rail strip, said at least one quick release cleat further having locking means, said locking means being user-movable between an open un-locked position and a closed, locked position, said locking means comprising a convenient user-openable and user-closable means for attaching and alternately detaching said cleat from said at least one semirigid rail strip, said groove on said inner surface of said at least one cleat for slidably grasping said at least one semirigid rail strip; said groove securely but slidably fixing said cleat to said at least one semirigid rail strip; and wherein said outer surface of said cleat has means for releasably securing a field gear pocket thereto.

Optionally any one of the embodiment described herein above, can be provided with spaced apart upwardly extending short suspension straps. They can be made of a suitably strong and flexible belting material, and be able to be secured to said system between the third and said fourth layer by means of the layer fastening means. They are equipped with fastening means affixed to their upper end for receiving a complementary fastening means and for being secured either on a vest-like apparatus or a harness or another belt on the user for better support.

Optionally, any one of the embodiments described herein above can be mounted on a four-point suspension harness comprised of a pair of crossed suspension straps, comprising a pair of rear straps and a pair of front straps, said harness having a pair of respective shoulder pads disposed respectively on said pair of straps, said pair of straps having a total of four downwardly extending ends, said ends respectively having fastening means affixed thereto for receiving a complementary fastening means from said short suspension straps of said multilayered field gear securing system; said harness for distributively hanging a portion of the weight of said field gear securing system from the shoulders of a user, said suspension harness being configured in the manner of a pair of conventional apparel suspenders; and wherein said pair of front straps have user adjustment means for adjusting the length thereof for a comfortable and effective weight bearing fit.

Optionally, any one of the embodiments of the apparatus described herein above can be mounted on any part of the user's torso, as for example on the waist or the chest or anywhere in between.

In any one of the embodiments described above the means for fastening the multiple layers of the system together can be a plurality of spaced apart rivets extending perpendicularly to the plane of said system from the outer surface of the first layer through respective corresponding apertures in each layer to a termination upon the inner surface of the fourth layer. The rivets hold the layers securely together into a unified system.

Figure 34:
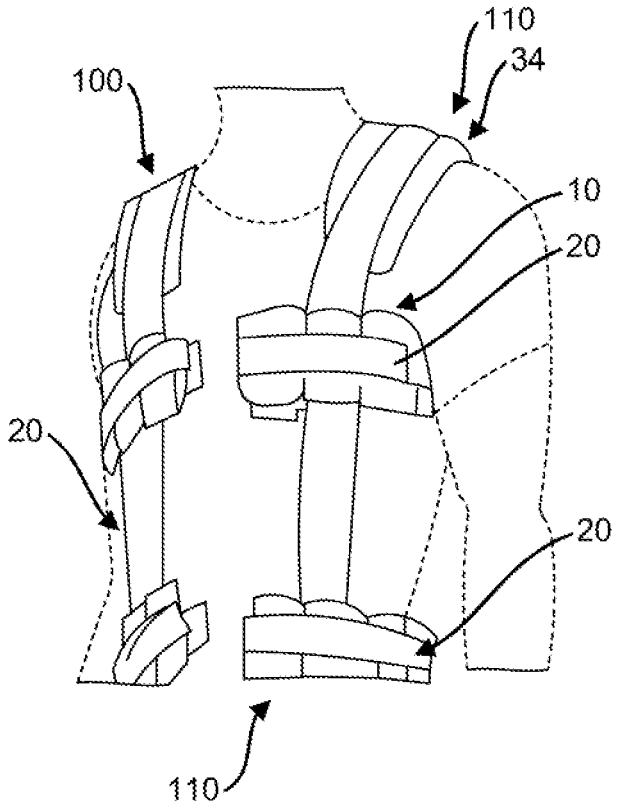
FIG. 34 is a three dimensional perspective of another embodiment having two of the inventive apparatus as appended of the harness-like or suspender vest of the present invention without storage compartments or pockets.
Figure 35:
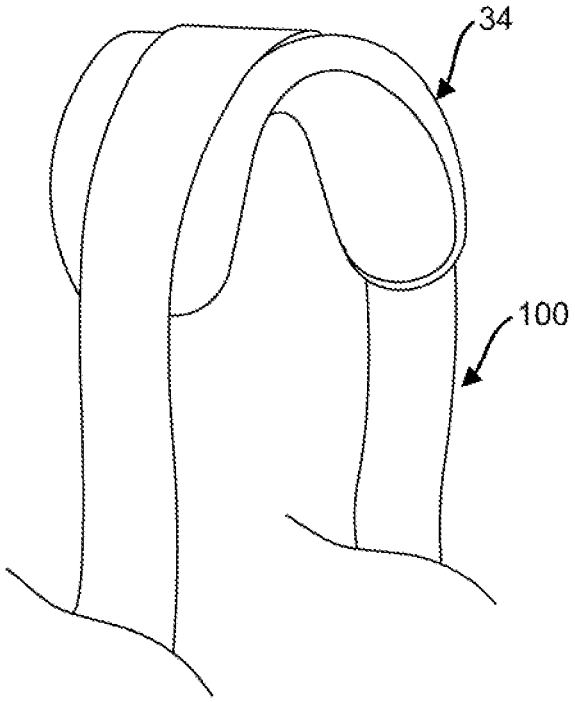
FIG. 35 is a three-dimensional perspective of the shoulder section of the vest-like apparatus of FIG. 34.

As was set forth herein above, FIGS. 24-34 and FIG. 41 generally depict the inventive apparatus as it is appended on a vest-like apparatus at 10. It is put on just like a regular jacket or a regular vest. It consists of a front panel and a back panel. The front panel overlays and optionally covers the front of the user's torso, and the back panel overlays and optionally covers the back of the user's torso. Each of the front and back torso panels is formed by at least one pair of shoulder straps 100, which overlay across the top of and are supported by the user's shoulders, and at least one rotating utility belt 110 fixedly attached to said shoulder straps. As shown in FIGS. 34 and 35, both straps 100 may optionally be provided with padding 34 to provide comfort to the user's torso and shoulders when the harness-like vest is worn by its user.

The harness-like vest and the corresponding belt-like apparatus 10 is closed and secured by quick release clips 120, preferably heavy duty, located at the ends of the belt like apparatus 110 and optionally in the front of the user's torso as shown in FIG. 34. The harness-like apparatus must be closed to activate the rotation or spinning or revolution of the traveler member 20 around the user's torso. It is the belt-like apparatus in turn, which is provided with the equipment storing apparatus for the storage of and accessibility to equipment and accessories on the harness-like vest.

Figure 36:
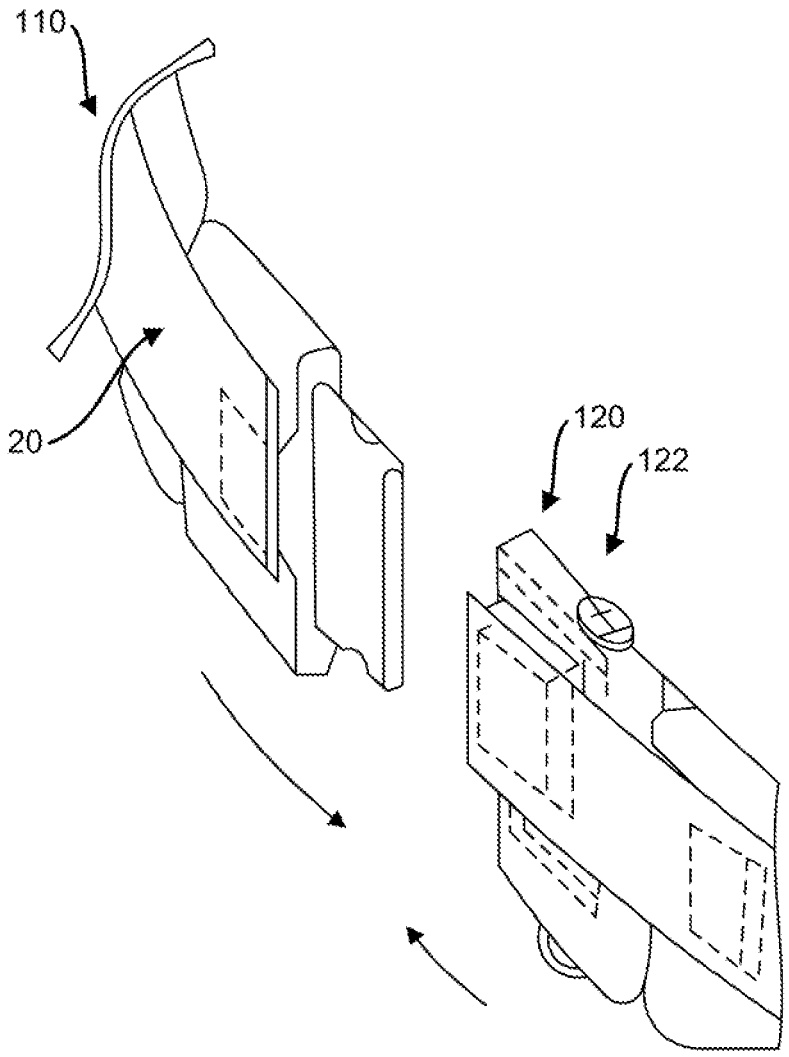
FIG. 36 is a three dimensional perspective of a section of the vest-like apparatus of FIG. 34.
Figure 37:
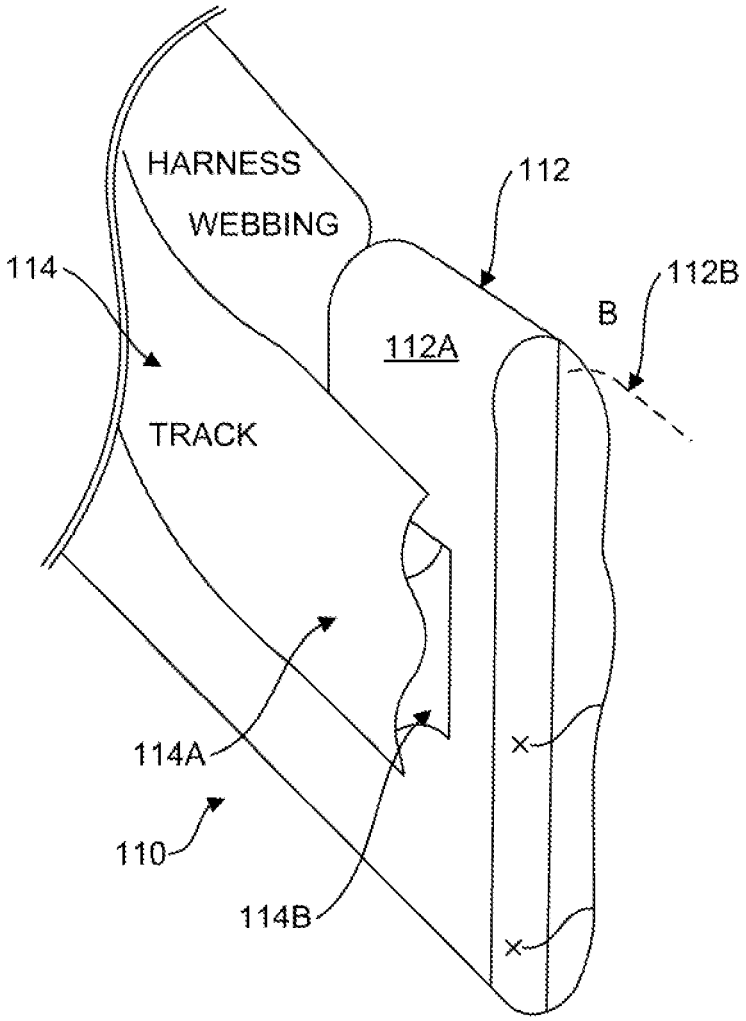
FIGS. 37-40 are three dimensional exploded perspectives of the individual components of the vest-like apparatus of FIG. 34.
Figure 41:
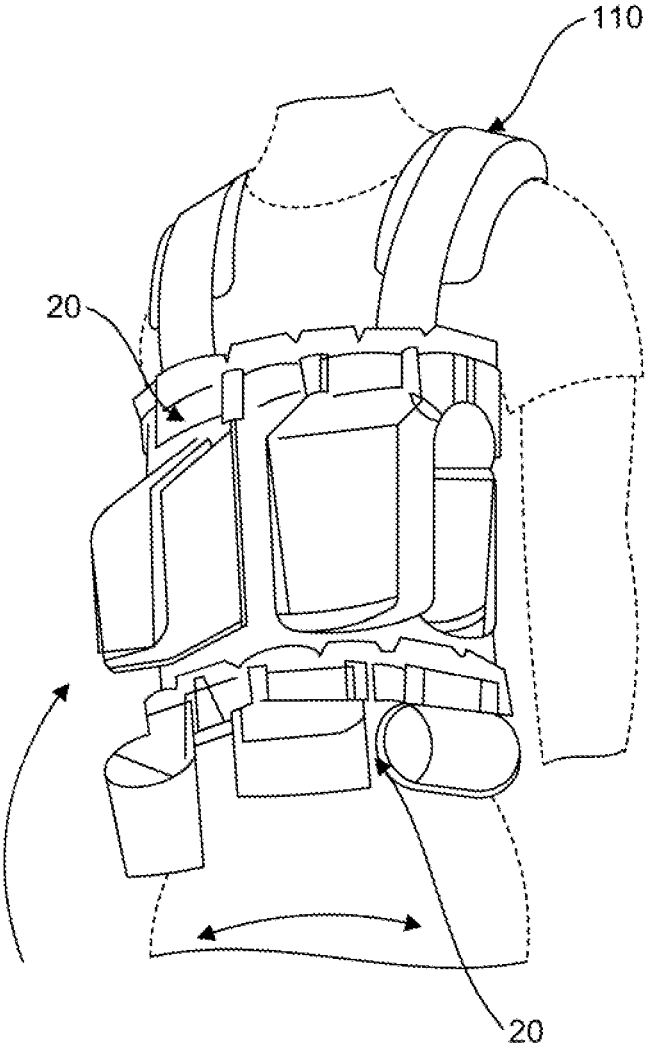
FIG. 41 is a three dimensional perspective of the vest-like apparatus of FIG. 34, fully assembled and worn by its user.

In the preferred embodiment of the harness-style vest shown in FIGS. 34 and 41, there are at least two inventive belt-like apparatus 110 connected to the shoulder straps 100. This provides for two levels of circumvolution and storage. On each level there is a quick release clip 120 located at the center of the front panel. One on each level, to comfortably secure and connect the entire system and make it ready for rotation. As can be seen from FIG. 36, the quick release clips can be disengaged with a quick release button 122 located on the top of the quick release clip 120.

The belt-like apparatus 110 comprises a webbing 112, a traveler system 114, and channel members 116, mounted and engaged on said traveler system 114. The webbing 112 has an inner surface 112B that abuts the user's torso and an outer surface 112A that faces away from the user's torso. The outer surface 112A of the webbing 112 acts as the support base upon which the traveler system 114 is permanently attached and supported by. When the quick release clips 120 are secured, the traveler system 114 completely encircles and encloses the user's torso.

The traveler system 114 functions similarly to railroad tracks. It provides the base upon which the channel members 116 (equivalent to traveler members 60) are mounted, which in turn allow for the attachment and mounting of the storage compartments or pouches or pockets 70. It is made up of individual track sections that are mounted on the webbing 112 and interconnected to form a continuous track around the user's torso. As a result, the channel members 116, mounted on the traveler system 114, can move both clockwise and counterclockwise.

In one embodiment of the traveler system shown in FIG. 37-40, a single thin traveler band 114A is constructed from either metal or plastic by either fixedly mounting it on, or by unitarily molding it with, a relatively thicker, smaller dimensioned base 114B. The base 114B is then permanently mounted on the webbing 112 of the inventive belt-like apparatus 110 thereby causing the traveler band 114A to face away from the torso of the user. Alternatively, the traveler band 114A could be tubular and mounted on the center of a plate-like base 114B, which in turn is mounted on the webbing 112 of the inventive belt-like apparatus 110.

Figure 38:
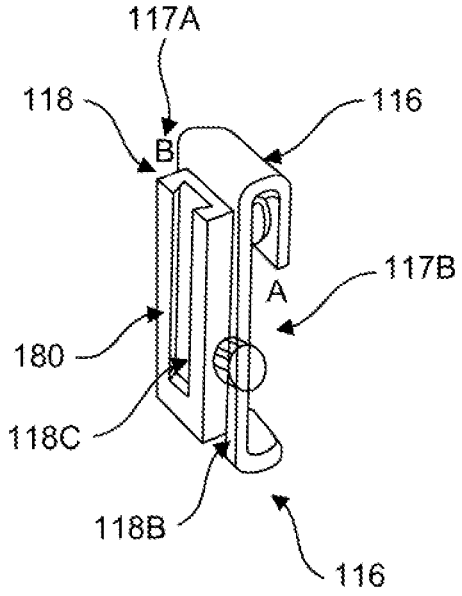
Figure 39:
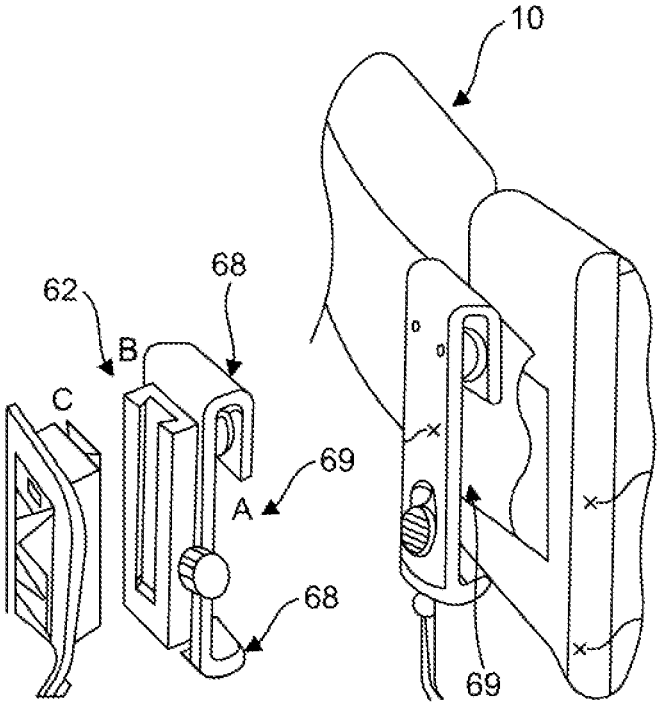
Figure 40:
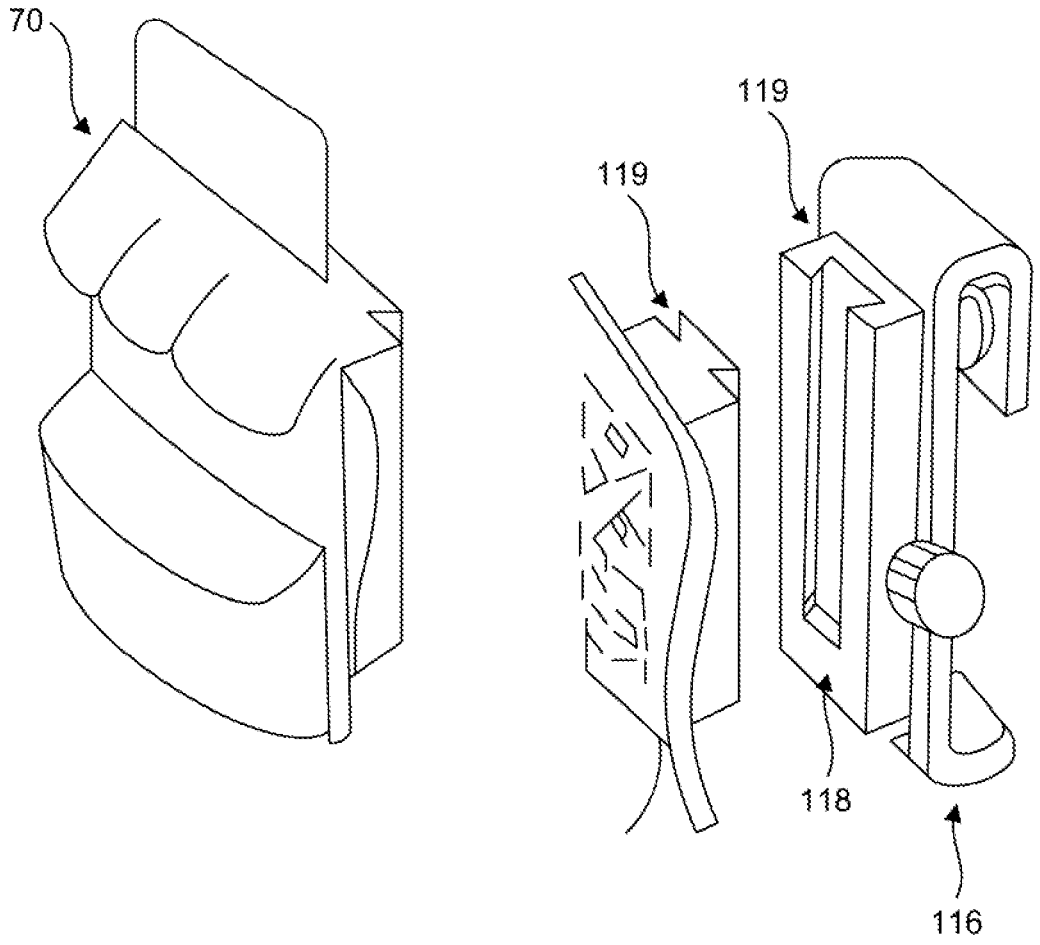

As was set forth herein above, the inventive belt-like apparatus 110, further comprises channel members 116. FIGS. 38-40 display one embodiment of a channel member 116, for use with the thin traveler band disclosed herein above and shown in FIG. 37. It is adapted to engage and move relative to the flat travel band along the entire length of the travel band. It comprises a saddle 117 and a bracket 118.

The saddle 117 has an inner side 117B and an outer side 117A. The inner side 117B is arc or u-shaped, imparting to the channel member 116 a receiving end, which encases and is in sliding engagement with the thin travel band 114A along the entire length of the travel band. Alternatively, the sliding channel member may include square, rectangular, etc., dimensioned receiving ends where alternative dimensioned and shaped travel bands 114A are utilized. The diameter, thickness and length of the receiving ends of the channel members 116 allow for their secure engagement of the travel band within their receiving ends, to form and provide the stable support structure for the storage and easy access of the equipment mounted thereon, whether the channel members are located on the front panel or the back panel.

The bracket 118 is fixedly attached, mounted on, or unitarily molded with the outer surface 117A of the saddle 117, of the channel member 116. The bracket 118 also has an outer surface 118A, which in turn is provided with a slide channel 118C having inner dimensions that are wider than its outer dimensions. The slide channel 118C receives a male connection 119 of a clip attached to equipment-holding pockets or pouches 70, and supports all camera equipment mounted on the outer surface of the channel member. As shown in FIG. 40, once the channel member 116 is slidably mounted on the track, the pocket/storage pouch 70 designed for specific equipment and having the male counterpart 119 is inserted and slid into the slide channel 118C of the outer surface of the bracket 118 supported by the saddle 117 of the channel member 116 and locks securely thereto, in a lock-and-key mechanism. FIG. 40 shows a storage pouch pocket complete with the male counterpart 119 of the channel member 116 attached to one side of such storage pocket.

Alternatively, instead a bracket, the channel member 116 may be equipped with heavy duty magnets, buttons, or snaps that could be used to secure the storage pouches or pockets 70 thereto. The storage pouches or pockets will be made of tough waterproof material and all will be padded for the added protection of the equipment.

In practice, the channel members 116 are mounted on the single continuous travel band encircling the torso of the user. The user is able to load equipment on both the front and the back portion of the harness-like vest. Once the equipment is mounted and locked on the travel, it can be easily and quickly accessed by the user at the front of user's torso by simply moving and spinning the channel members and the pouches supported thereon, around the travel band. FIG. 41 shows a fully loaded harness like vest in use and capable of revolving around the user's torso to provide access to all equipment without the removal of the harness like vest.

While particular embodiments of the invention have been illustrated and described in detail herein, they are provided by way of illustration only and should not be construed to limit the invention. Since certain changes may be made without departing from the scope of the present invention, it is intended that all matter contained in the above description, or shown in the accompanying drawings be interpreted as illustrative and not in a literal sense. Practitioners of the art will realize that the sequence of steps and the embodiments depicted in the figures can be altered without departing from the scope of the present invention and that the illustrations contained herein are singular examples of a multitude of possible depictions of the present invention.

Accordingly, we claim:

1. A wearable track system, comprising:

a strap having a first fastening end, a second fastening end, and a strap length separating the first fastening end from the second fastening end; and a track extending along the strap length and disposed on the strap via at least one spacer, the track having a first end and a second end, wherein the first end extends beyond the first fastening end and the second end extends beyond the second fastening end, each of the first end and second end being configured to couple to one another to thereby form the track into a continuous looped structure.

2. The wearable track system of claim 1, further comprising at least one saddle detachably coupled to the track.

3. The wearable track system of claim 2, wherein the at least one saddle has a C-shaped groove configured to slidably and removably engage the track.

4. The wearable track system of claim 2, wherein the at least one saddle is configured to slidably and removably engage the track at any point along the track.

5. The wearable track system of claim 2, further comprising a locking mechanism on the at least one saddle.

6. The wearable track system of claim 4, wherein the at least one saddle has a C-shaped groove configured to slidably and removably engage the track.

7. The wearable track system of claim 3, wherein the at least one saddle is configured to slidably and removably engage the track at any point along the track.

8. The wearable track system of claim 3, further comprising a locking mechanism on the at least one saddle.

9. The wearable track system of claim 4, further comprising a locking mechanism on the at least one saddle.

10. The wearable track system of claim 1, wherein the first end and the second end couple via a slidable tongue.

11. The wearable track system of claim 10, further comprising at least one saddle detachably coupled to the track.

12. The wearable track system of claim 11, wherein the at least one saddle has a C-shaped groove configured to slidably and removably engage the track.

13. The wearable track system of claim 11, wherein the at least one saddle is configured to slidably and removably engage the track at any point along the track.

14. The wearable track system of claim 11, further comprising a locking mechanism on the at least one saddle.

15. The wearable track system of claim 14, wherein the at least one saddle has a C-shaped groove configured to slidably and removably engage the track.

16. The wearable track system of claim 12, wherein the at least one saddle is configured to slidably and removably engage the track at any point along the track.

17. The wearable track system of claim 15, further comprising a locking mechanism on the at least one saddle.

18. The wearable track system of claim 16, further comprising a locking mechanism on the at least one saddle.

19. A wearable track system, comprising:

a strap having a first fastening end, a second fastening end, and a strap length separating the first fastening end from the second fastening end, each of the first fastening end and the second fastening end being configured to couple to one another to thereby form a substantially circular garment configured to receive a portion of a user's body;

a track extending along the strap length and disposed above the strap via at least one spacer, the track having a first end and a second end, wherein the first end extends beyond the first fastening end and the second end extends beyond the second fastening end, each of the first end and second end being configured to couple to one another to thereby form a continuous circular travel path, wherein the continuous circular travel path is substantially concentric with the substantially circular garment; and at least one saddle detachably coupled to the track, wherein the at least one saddle either has a C-shaped groove configured to slidably and removably engage the track or has a locking mechanism, wherein a location of coupling the first end and the second overlaps with a location of coupling the first fastening end and the second fastening end.

20. A track belt, comprising:

a belt;

a track disposed away from the belt via a spacer, the track having a first end and a second end, each of the first end and the second end extending beyond the length of the belt when the track is disposed thereon; and a sliding-coupling disposed on either the first end or the second end of the track, the sliding-coupling being configured to connect the first end to the second end to form a continuous track loop in spaced relation to the belt.

* * * * *